United States Patent [19]

Notelteirs et al.

[11] 4,331,900

[45] May 25, 1982

[54] HALOGEN INCANDESCENT LAMP

[75] Inventors: Victor R. Notelteirs; Gustaaf F. R. Siaens, both of Eindhoven, Netherlands

[73] Assignee: U.S. Philips Corporation, New York, N.Y.

[21] Appl. No.: 132,943

[22] Filed: Mar. 24, 1980

[30] Foreign Application Priority Data

Apr. 11, 1979 [NL] Netherlands ..... 7902839

[51] Int. Cl.[3] ..... H01K 1/28

[52] U.S. Cl. ..... 313/222

[58] Field of Search ..... 313/222, 178, 179

[56] References Cited

U.S. PATENT DOCUMENTS 3,719,853 3/1973 Sugane et al. ..... 313/222

3,849,687 11/1974 Huston et al. ..... 313/222

*Primary Examiner*—Bruce C. Anderson

*Attorney, Agent, or Firm*—Robert S. Smith

[57] ABSTRACT

Two-pinch mains voltage halogen incandescent lamp according to the invention have metal foils (6) in the pinches (5) which foils are connected to respective internal current conductors (8) and respective external current conductors (10). The metal foils (6) extend beyond the pinches (5) into the cavity (7) formed by the lamp envelope (1). The internal current conductors (8) do not penetrate into the pinches (5). The construction prevents explosion of the lamps as a result of cracking of either pinch caused by a discharge arc.

1 Claim, 3 Drawing Figures

HALOGEN INCANDESCENT LAMP

Figure 1:
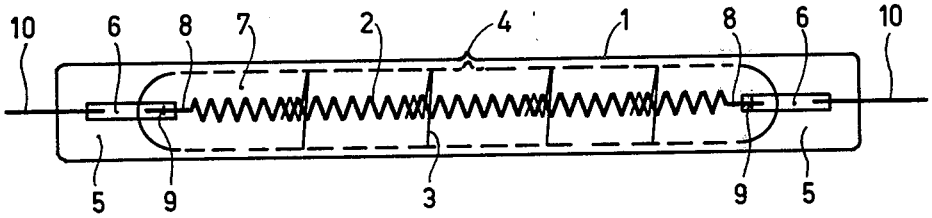

The invention relates to a line voltage halogen incandescent lamp having a tubular quartz glass lamp envelope filled with an inert gas containing hydrogen bromide and in which a tungsten filament is accommodated axially. The lamp envelope is sealed at each end in a vacuum-tight manner with a respective pinch around a respective metal foil, a respective external and a respective internal current conductor extending to the filament being welded to each of said foils.

Such a lamp is disclosed in British Patent Specification 1,094,694 in which the, metal foils are situated entirely in the pinch.

It has been found that at the end of their lives, such line voltage lamps may explode, even when an external fuse is used due to a crack in a pinch.

It is the object of the invention to provide a simple lamp construction which removes the danger of explosion by cracking of a pinch in line voltage lamps, that is to say lamps having a nominal voltage between 110 and 250 V, as a result of the formation of a discharge arc in the pinch.

In lamps of the kind mentioned in the opening paragraph this object is achieved in that the internal current conductors are present entirely within the cavity formed by the lamp envelope and that the metal foils each extend beyond the associated pinch up to the adjacent internal current conductor.

The invention is based on the following recognition. As a result of the large difference in coefficients of thermal expansion between quartz glass, by which are denoted glasses having an $SiO_2$ content of at least 95% by weight, and tungsten or molybdenum, a capillary space is present around the internal current conductors of known lamps extending into the pinches up to the metal foils. This means both that there is hardly any contact between the internal current conductors and the glass of the pinches, and also that the gas filling of the lamp is in contact with the internal current conductors in the pinches.

In lamps having a comparatively long life, the end of life can be reached in that so much metal is removed by halogen from one of the comparatively cold internal current conductors from a place situated within or just outside a pinch, that the internal current conductor fuses. A discharge arc will then be formed within the pinch or a discharge arc will be formed just outside the pinch and will penetrate into the pinch. This results in a very rapid evaporation of metal in the pinch. The resulting very high pressure in the pinch causes the pinch to crack and the lamp to explode.

In lamps having a comparatively short calculated life, the filament fuses after it has become thin in a hot place as a result of evaporation. The resulting discharge arc penetrates into a pinch which will then crack.

Due to structural measurer taken in the lamps according to the invention wherein the metal foils extend from the pinches into the cavity formed by the lamp envelope and are connected there by a weld to an internal current conductor and in which the internal current conductors do not extend into the pinch, the formation of a discharge arc in a pinch is precluded. Due to this measure it is also impossible for the discharge arc to penetrate into the pinch.

In spite of the difference in coefficients of expansion between the metal of the foils (of tungsten or molybdenum) and the glass of the pinches, said glass surrounds the foil tightly due to the small thickness of the foils (namely a few tens, for example 30, microns). As a result of the intimate contact between the foils and the glass of the pinches, thermal energy is easily dissipated from the foil. A discharge arc which is formed inside the lamp envelope will extinguish as soon as it has approached a pinch. In the case in which an internal current conductor melts but is so thick that a discharge arc remains thereon without fusing, the connection between the internal current conductor and the metal foil will be interrupted as a result of the thermal energy evolved therein.

Inside a pinch no interruption of the electric connection can occur any longer because the gas filling of the lamp cannot penetrate into the pinch.

A limb of the filament may serve as an internal current conductor, in which case the internal current conductor and filament are manufactured from one piece of material. It is alternatively possible, however, that an internal current conductor is a separate component which is screwed, for example, into or around the filament. With a view to the explosion-safety of the lamp, no requirements need be imposed upon the thickness of the internal current conductor because no part of it is situated inside a pinch.

Lamps according to the invention of high power, for example 500 Watts and more, have proved to be particularly suitable for use as photolamps, studio lamps, copying lamps, and the like.

It is to be noted that a mono-pinch iodine lamp for use in optical systems is known from U.S. Pat. No. 3,543,078. The lamp has a compact filament and is consequently destined for operation at low voltage. In this known lamp the metal foils extend into the lamp envelope. However, the object of this is to control vibrations of the filament and to prevent the limbs of the filament from emitting light. In this lamp the internal current conductors extend into the pinch. Explosion safety is not an object of the construction of this known lamp. On the one hand, danger of explosion does not occur in lamps which are operated at a low voltage, on the other hand, the construction shown in FIG. 2 prevents an intimate contact between the metal foils and the glass of the pinch.

Embodiments of lamps according to the invention are shown in the accompanying drawing. In the drawing FIG. 1 is an elevation of a line voltage halogen lamp; and FIG. 2 and FIG. 3 are elevations of a detail of a modified embodiment of a lamp.

In FIG. 1, a filament 2 is arranged axially in a tubular lamp envelope 1 and is centrally positioned by supports 3. The lamp envelope is sealed in a vacuum-tight manner by means of exhaust tube seal 4 and respective pinches 5 at each end. A metal foil 6, for example of tungsten or molybdenum, is present in the pinches 5 and extends into the cavity 7 formed by the lamp envelope 1. The limbs 8 of the filament 2 are each welded to a respective foil 6 at point 9. External current conductors 10 are also secured to said foils.

Figure 2:
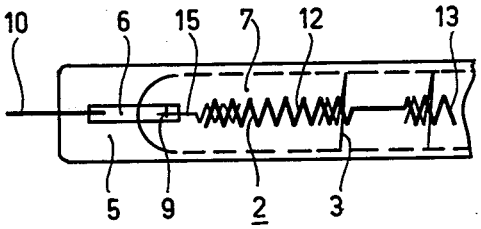

In FIG. 2 the filament 2 has a number of light emissive sections 12 and 13. The internal current conductor 15 in this case is a separate component which is screwed in section 12.

Figure 3:
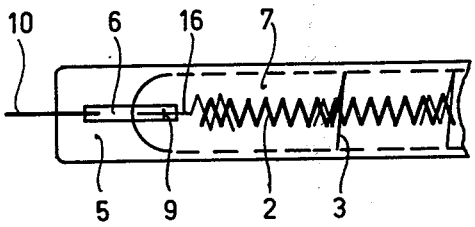

The internal current conductor 16 in FIG. 3 is also a separate component from the filament. It is screwed around a filament 2.

The lamp shown in FIG. 1 is a 220 V 1000 W photolamp having a filament of tungsten wire of 180 μm diameter and a colour temperature of 3400° K. The lamp comprises 1 bar $Ar/N_2$ 92/8 vol/vol, to which 2.4% by volume of HB2 has been added. The metal foils consist of molybdenum and have a largest thickness of 30 μm.

Experiments have proved that the lamp, as well as the lamps shown in FIGS. 2 and 3, are safeguarded effectively against explosions.

What is claimed is:

1. A line voltage halogen incandescent lamp having a tubular, quartz glass lamp envelope which is filled with an inert gas containing hydrogen bromide, a tungsten filament disposed axially in said envelope and two metal foils, said lamp envelope being sealed in a vacuum-tight manner at each end by means of a respective pinch around one of said metal foils to define a cavity within said envelope between said pinches, said lamp also including a respective external and a respective internal current conductor for the filament, each being welded to one of said foils, each of said internal current conductors being welded to said foils in said cavity, said internal current conductors being disposed entirely within said cavity formed by the lamp envelope and said metal foils each extending beyond the associated pinch to an internal current conductor.

* * * * *